US005799623A

United States Patent [19]

Born et al.

[11] Patent Number: 5,799,623

[45] Date of Patent: Sep. 1, 1998

[54] SUPPORT SYSTEM FOR FEEDSTOCK COIL WITHIN A PYROLYSIS FURNACE

[75] Inventors: Sidney L. Born, 4241 S. Victor Ave., Tulsa, Okla. 74105; James M. Masters, Bristow, Okla.

[73] Assignee: Sidney L. Born, Tulsa, Okla.

[21] Appl. No.: 746,851

[22] Filed: Nov. 18, 1996

[51] Int. Cl.[6] ..... F22B 37/24

[52] U.S. Cl. ..... 122/510; 122/496; 122/493

[58] Field of Search ..... 122/493, 496, 122/510, 6 R, 367.1, 367.2, 367.3

[56] References Cited

U.S. PATENT DOCUMENTS

| | | | |
|---|---|---|---|
| 3,554,168 | 1/1971 | Woebcke | 122/510 |
| 3,599,912 | 8/1971 | Stephens | 248/58 |
| 3,599,914 | 8/1971 | Stephens | 248/68 |
| 4,020,273 | 4/1977 | Dix et al. | 13/7 |
| 4,570,702 | 2/1986 | Stafford et al. | 122/367.3 |
| 4,986,222 | 1/1991 | Pickell et al. | 122/6 R |

FOREIGN PATENT DOCUMENTS

| | | | |
|---|---|---|---|
| 2041181 | 9/1980 | United Kingdom | 122/367.1 |

*Primary Examiner*—Henry A. Bennett
*Assistant Examiner*—Gregory A. Wilson
*Attorney, Agent, or Firm*—Head, Johnson & Kachigian

[57] ABSTRACT

An improved means for mounting and supporting the helical feedstock coil within a pyrolysis furnace, by providing vertical support members which have an internal passageway that allows for coolant to be passed through, thus reducing the temperature of said support members and enabling the use of less expensive structural material and fabrication technique with resulting cost savings and enhanced reliability and useful life of the tube supports and furnace.

7 Claims, 2 Drawing Sheets

SUPPORT SYSTEM FOR FEEDSTOCK COIL WITHIN A PYROLYSIS FURNACE

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

This invention relates generally to pyrolysis furnaces, particularly those pyrolysis furnaces where the feedstock is heated within a serpentine coil fired on one or both sides of the coil. More particularly this invention has to do with an improved support system for such serpentine feedstock coils within a pyrolysis furnace.

At the present time such furnaces consists of large fireboxes typically of rectangular construction which are about fifty feet long by about eight feet wide and typically range in height from twenty to twenty-five feet high. In the center of the firebox is a feedstock tube bundle which typically starts at the top left of the firebox and extends horizontally almost the full length of the firebox, then makes a sharp 180° "U" bend and extends almost the full length of the firebox towards the starting end, then making a sharp 180° "U" bend, it winds back and forth inside the firebox in a serpentine fashion until it exits the firebox at the bottom right thereof.

The feedstock tube thus wound in a coil needs to be supported, and the present design provides for a series of vertical support members which are placed at spaced intervals along the length of the firebox in the center of the serpentine feedstock coil or double serpentine feedstock coil. Support arms attached to and extending from the support members support the successive loops of the serpentine feedstock coil. The entire assembly is supported from the top of the firebox.

The firebox is surrounded by burners which burn fuel and introduce heat to the furnace. These burners may be located on the bottom, on the sides or on the top of the firebox or a combination thereof. In each instance heating of the air within the furnace takes place as does heating of the serpentine coil and the feedstock moving within as well as the support members.

Due to the relatively high temperatures required to accomplish the cracking or other chemical processes, the entire assembly including the serpentine coil and vertical supports are subjected to heat stresses. Existing vertical supports are typically made by casting of the support pieces from specialized high temperature materials of differing microscopic structures. The vertical support member may be centrifugally cast in short sections and the sections welded together to make a full length vertical support, while the finger supports and head assembly are statically cast and welded onto the vertical support.

Although the present system can be made to produce good results in the construction of such furnaces, it is an expensive and difficult process. Furthermore, due to the nature of both the casting process and resulting differential grain structure and the material used, cracking upon cooling and latent cracking may result. Latent cracking results, it is believed due to dissimilar grain structure of the cast materials, welding materials and centrifically cast spun material. Avoiding such difficulties increases production time and results as well in decreasing yields in the cracking process in production. Furthermore, the latent cracking is difficult to recognize, thus causing an increase in the maintenance of such furnaces while in operation, and may result in decreased operating life.

BRIEF SUMMARY OF THE INVENTION

This invention deals with a pyrolysis furnace and in particular a vertically hung feedstock coil support system that overcomes the problems inherent in existing systems.

The invention relates to an internally cooled vertical support member, thus allowing the use of a range of wrought or cast alloy materials having good strength characteristics at the cooled temperatures. The change to such readily available material reduces raw material costs. The inherent strength of the air cooled wrought material reduces thickness and thus weight and cost for the support. Fabrication is easier, faster, and latent cracking is eliminated. The design calls for a hollow support member through which coolant is introduced at the bottom thereof and removed at the top. In operation, air, water or other suitable coolant may be used. Ambient air would flow through the support member and be vented at the top thereof by natural induced convection currents. Further, atmosphere enhancements in cooling air flow may be obtained by connecting the output at the top of the support member to a point further up in the exhaust flue of the furnace, producing additional draft.

A better understanding of the invention will be obtained from the following description of the preferred embodiments, taken in conjunction with the attached drawings.

DETAILED DESCRIPTION OF THE PREFERRED EMBODIMENTS

Figure 1:
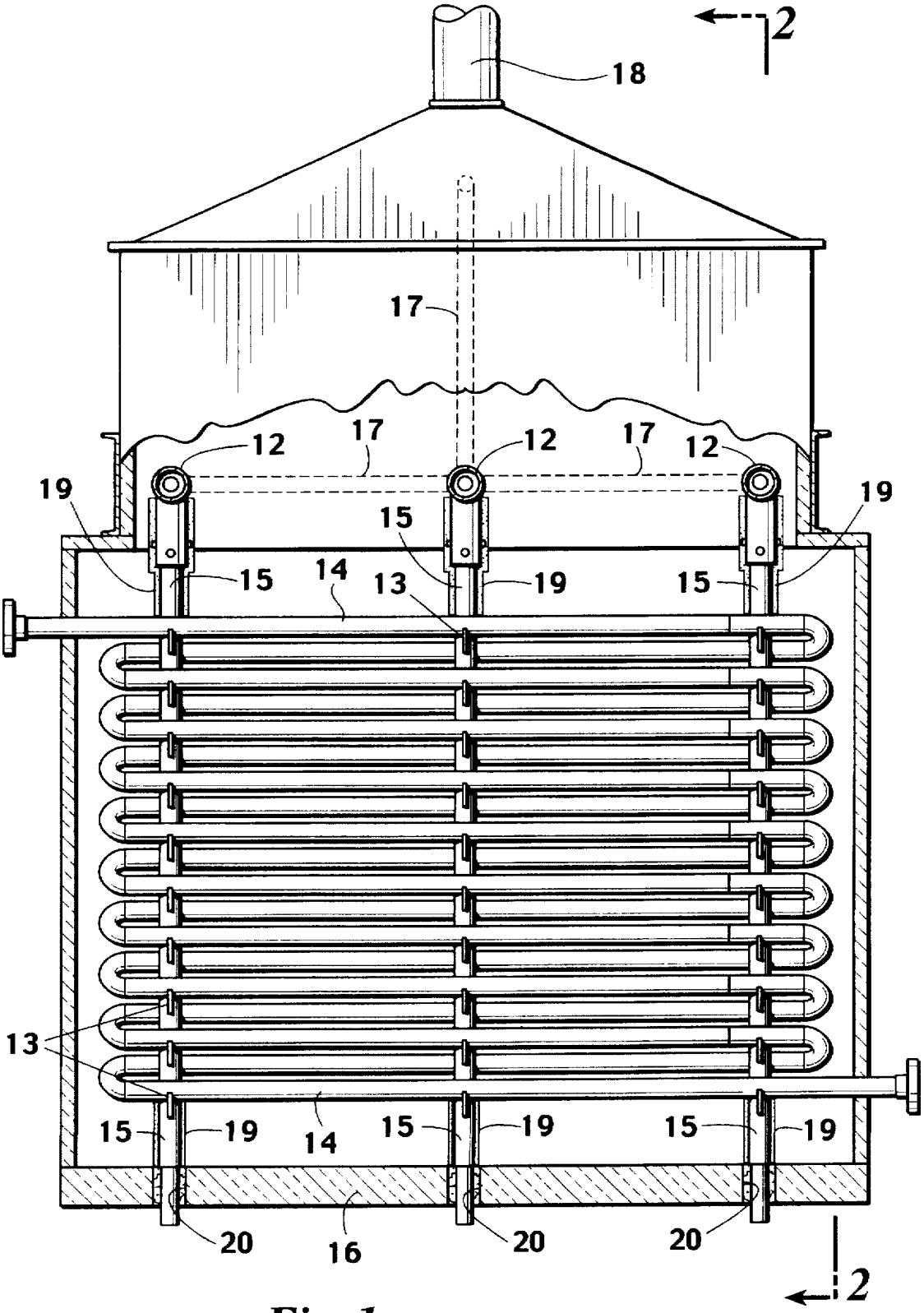
FIG. 1 is a front elevational view, partially sectional, partly schematic of one embodiment of a pyrolysis furnace utilizing the cooled top hung feedstock coil support.
Figure 2:
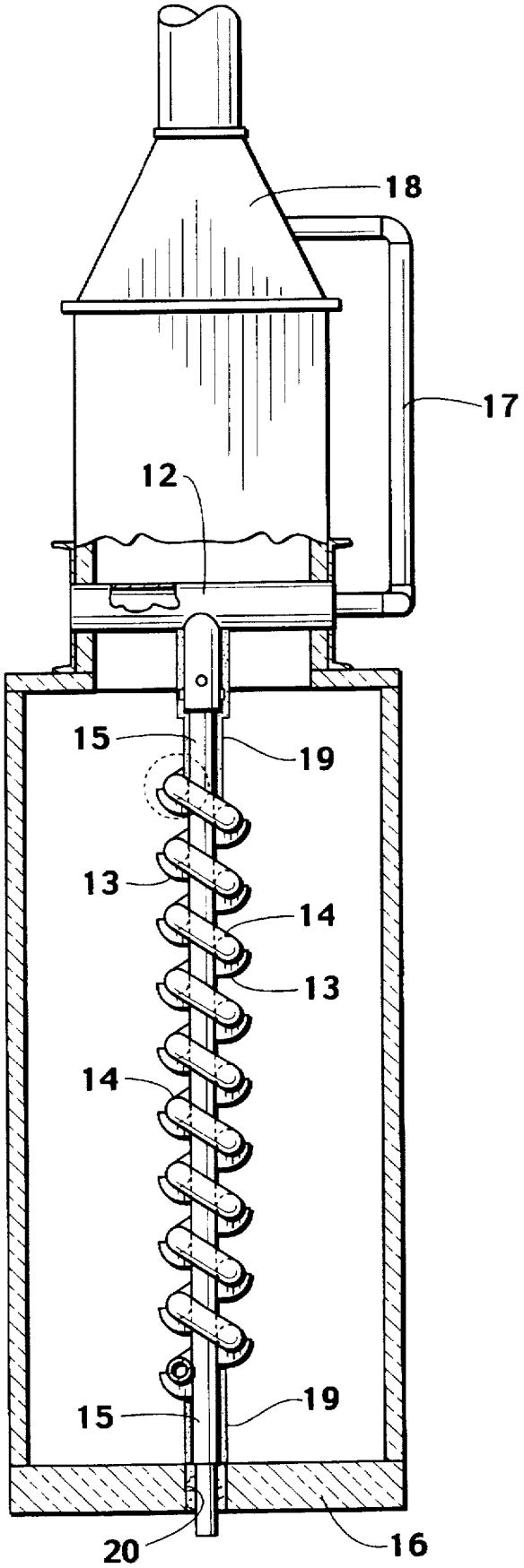
FIG. 2 is a side elevational view partly sectional, partly schematic of one embodiment of a pyrolysis furnace utilizing the cooled top hung feedstock coil support and showing the induced draft feature for air cooling.

Turning now to FIG. 1, an overall side elevational view of a pyrolysis furnace is depicted. In the example there are three cooled top hung feedstock vertical coil support members 15 shown. These support members are attached to T-shaped cross members 12 as also shown in FIG. 2. The cross members 12 are structurally supported at each end by the firebox walls and are designed such that they may allow for swivel movement about their longitudinal axis. The vertical support members have fingers 13 welded or otherwise affixed to opposite sides of their outer surface. These fingers 13 are intended to support the serpentine feedstock coil 14. In the embodiment shown the feedstock coil winds around both sides of the top hung supports, although in other embodiments the feedstock coil could be supported on only one side or two separate coils could be supported one each on opposite sides of the vertical support members.

Turning to FIG. 2, the top hung support member 15 is designed to be hollow to allow a passageway for cooling air or fluid to pass on the inside of the member. In the preferred embodiment ambient cooling air enters the top hung support 15 at a point below the firebox 16 and moves upward through the T-shaped top support 12 wherein the air exits to the outside of the furnace. In the preferred embodiment, a duct 17 connects the cooling air exhaust from the T-shaped top support 12 to a point further up in the flue 18 of the furnace. In this manner an induced draft creates additional air flow through the inside of the vertical support 15 thus improving the cooling rate. The outside or firebox side of the vertical support 15 is coated with insulation 19, to further protect the support member from the high temperatures within the furnace. Additional cooling may be obtained by installing fans or pumps to force additional cooling air or other coolant to flow through the support member. At the bottom end the support member is not fixedly attached to the floor of the furnace and is in fact allowed to move within the opening 20 which is sealed with a compressible material. In this manner expansion of the support member 15 due to temperature changes may be accommodated without undue stresses.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A support system for feedstock coils within pyrolysis furnaces comprising:

a plurality of vertically positioned hollow pipes or conduits spaced at intervals along the horizontal length of a serpentine feedstock coil, said hollow pipes or conduits having support arms attached to said pipe or conduit outer surface and extending outward in opposite directions to support said serpentine feedstock coil;

said plurality of vertically positioned hollow pipes or conduits having an open end at the bottom thereof to allow for coolant to enter and having an open end at the top thereof for the exit of said coolant;

said support system being suspended from a hollow T section which is allowed to pivot about its supports at opposite ends of said top of said T section.

2. A support system for feedstock coils within pyrolysis furnaces as described in claim 1 where the coolant is ambient air.

3. A support system for feedstock coils within pyrolysis furnaces as described in claim 2 wherein the air coolant flow is enhanced by the natural draft provided by connecting the exhaust of said cooling air from the outside of one end of said T section to the furnace exhaust stack above said T section.

4. A support system for feedstock coils within pyrolysis furnaces as described in claim 1 wherein said vertically positioned hollow pipes or conduits are insulated on the outer or firebox surface thereof.

5. A support system for feedstock coils within pyrolysis furnaces as described in claim 1 wherein said vertically positioned hollow pipes or conduits are made of wrought or extruded pipe.

6. A support system as described in claim 5 wherein said extruded pipe is made of stainless steel.

7. A support system as described in claim 5 wherein said extruded pipe is made of 1.25% chrome alloy.

* * * * *

UNITED STATES PATENT AND TRADEMARK OFFICE

CERTIFICATE OF CORRECTION

PATENT NO. : 5,799,623

DATED : September 1, 1998

INVENTOR(S) : Sidney L. Born et al..

It is certified that error appears in the above-identified patent and that said Letters Patent is hereby corrected as shown below:

Cover Page:

[57] ABSTRACT: Line 1, delete "helical" and substitute --serpentine-- therefor; and Col. 2, line 49, "side" should be deleted and --front-- substituted therefor.

Signed and Sealed this

Fourteenth Day of December, 1999

*Attest:*

Q. TODD DICKINSON

*Attesting Officer*

*Acting Commissioner of Patents and Trademarks*